US005691630A

United States Patent [19]

Chosa

[11] Patent Number: 5,691,630

[45] Date of Patent: Nov. 25, 1997

[54] POWER SUPPLY CONTROL APPARATUS

[75] Inventor: Takashi Chosa, Tokyo, Japan

[73] Assignee: Canon Kabushiki Kaisha, Tokyo, Japan

[21] Appl. No.: 539,077

[22] Filed: Oct. 4, 1995

[30] Foreign Application Priority Data

Oct. 12, 1994 [JP] Japan ..... 6-245808

[51] Int. Cl.[6] ..... G05F 1/577

[52] U.S. Cl. ..... 323/267; 307/75; 307/39; 307/87; 307/130

[58] Field of Search ..... 307/20, 23, 29, 307/75, 39, 43, 45, 48, 130, 131, 87, 82; 323/225, 267, 268, 271, 283, 285

[56] References Cited

U.S. PATENT DOCUMENTS 4,163,906 8/1979 Shimamura ..... 307/39

5,202,725 4/1993 Oku ..... 355/69

*Primary Examiner*—Peter S. Wong
*Assistant Examiner*—Shawn Riley
*Attorney, Agent, or Firm*—Fitzpatrick, Cella, Harper & Scinto

[57] ABSTRACT

A power supply control apparatus for controlling a power supply circuit for outputting voltages of at least two systems is constructed by a first power supply circuit for generating a first voltage and a second power supply circuit for generating a second voltage, a controller circuit which is driven by the first voltage, a disconnecting circuit for disconnecting the second voltage by the controller circuit in accordance with a predetermined condition, a power supply controller circuit for controlling the second power supply circuit on the basis of the second voltage, and a supplying circuit for supplying a signal indicative of a state in which the second voltage has been outputted to the power supply controller circuit when the second voltage is disconnected by the disconnecting circuit.

12 Claims, 4 Drawing Sheets

POWER SUPPLY CONTROL APPARATUS

BACKGROUND OF THE INVENTION

1. Field of the Invention

The invention relates to a power supply control apparatus and, more particularly, to a power supply control apparatus having a plurality of power supply circuits of at least two or more systems and a power supply controller circuit for commonly controlling those plurality of power supply circuits.

2. Related Background Art

Various kinds of electronic and electric apparatuses need a stabilizing power supply circuit for supplying a necessary electric power in accordance with their operating systems, application fields, or the like. The stabilizing power supply circuit converts an input voltage which is supplied from an AC power supply or the like and stabilizes the voltage (or current) and supplies to a load.

In many cases, many apparatuses need voltages of two or more systems instead of only one system. Therefore, a power supply circuit or the like which is built in the apparatus often needs to extract output voltages of two or more systems from an input voltage of one system.

For example, there is a case where a voltage of DC 5 volts for a logic circuit system and a voltage of DC 9 volts for driving a motor are formed from the voltage of AC 100 volts. On the other hand, there is a case where a voltage of 5 volts for a logic circuit system and a voltage of 20 volts for a certain module are formed from the input voltage of about DC 10 volts by a DC/DC converter. In this way, various constructions are considered.

However, in those power supply circuits, all of the voltage systems don't always need to operate. In many cases, it is sufficient that only partial systems operate in accordance with an operating state of the apparatus or a time zone.

Ordinarily, in the power supply circuit of each system, a circuit construction differs depending on its necessary voltage, necessary current, current consumption, and other conditions.

Therefore, there is a case where even if an electric power consumption of a certain system when no load is used is smaller than an electric power consumption of such a system when a load is used, it is larger than the electric power consumptions of the other systems when no load is used.

Therefore, when the electric power consumption of a certain system when no load is used cannot be ignored, the power supply circuits (or main circuit in the circuit) of the systems which don't need to be operated for a certain time are turned off, thereby suppressing the whole electric power consumption.

In a battery driven apparatus, what is called a power management control (power saving control) as mentioned above is particularly effective because an electric power consumption of the battery is reduced and an operable time of the apparatus is extended.

FIG. 3 shows an example of a construction for performing a conventional power management control. In FIG. 3, reference numeral 32 denotes a controller comprising a CPU, a memory, and other controller circuits. The controller 32 (or further other circuits) is driven by an output voltage AA of a controller power supply 31.

Another-system power supply 34 generates an output voltage BB for supplying another driving voltage or current to a different load. A power source of the power supply 34 is controlled by another-system power supply controller circuit 33.

Reference numeral 35 denotes a switch which is controlled by the controller 32 and controls the power supply of the another-system power supply 34 through the another-system P/S controller circuit 33.

In the above construction, the controller power supply 31 corresponds to the primary-system power supply. The another-system power supply 34 corresponds to the secondary-system power supply. The controller power supply 31 converts an input voltage and forms the output voltage AA and also supplies an electric power as a power source of the controller 32 or the like. The another-system power supply 34 converts the input voltage and forms the output voltage BB.

In the example, a current is always supplied to the controller power supply (primary-system) 31. The controller controls the whole apparatus and disconnects the another-system power supply 34 through a switching element, relay, or the like when it is unnecessary by disconnecting the switch 35 of the power supply controller circuit 33.

Such a control is particularly effective in the case where, for example, the another-system power supply 34 drives a load such as liquid crystal display circuit, its illuminating circuit, or the like having a relatively large current consumption.

As a method of disconnecting the another-system power supply 34, in addition to a method of disconnecting by the control of the controller 32 as mentioned above, there is also considered a method whereby a time during which the whole apparatus or the load which needs the output voltage BB is not used is measured by a control of a timer or the like and the power supply 34 is disconnected in accordance with a measurement result.

In the power supply system having the power supplies of two or more systems as mentioned above, in the case where circuit systems are identical or similar, a method whereby circuits which can be commonly used among a plurality of systems to a certain degree are commonly constructed is ordinarily used.

This is because by such a common circuit forming method, an occupied space can be reduced or the circuit construction can be simplified. As examples of circuits which can be commonly constructed, there are circuits which are subjected to a power supply control, such as circuit for generating a reference voltage to be referred in each system, reference oscillating circuit in a switching system, overcurrent protecting circuit for taking a countermeasure for a reduction in output voltage by an overcurrent, and the like.

In the above conventional example, in the case where the power supply apparatus of each system is completely independent, for example, in case of a system such that a 3-terminal regulator is used as a controller power supply 31 and the another-system power supply 34 uses the switching system or the like, the power saving control can be easily realized by executing a control such that a power supply terminal of an IC for a switching power supply is disconnected by the controller 32.

However, in the case where the electric power that is used in the controller 32 and is supplied from a regulator is insufficient or the like, in many cases, both of the controller power supply 31 and another-system power supply 34 are constructed by switching power supplies, thereby executing the common circuit forming method as mentioned above. Accordingly, there is a tendency such that the controller circuit such as an overcurrent protecting circuit or the like is also commonly constructed among a plurality of systems.

However, in such a power supply apparatus including the power supply circuits of a plurality of systems in which a part or all of the controller circuits or the like are commonly constructed, there is a problem such that when the power supply of one system is once turned off due to the operation of the overcurrent protecting circuit, power failure detecting circuit, or the like, the power supplies of a plurality of systems, eventually, the power supply of the whole system is disconnected.

SUMMARY OF THE INVENTION

It is an object of the invention to solve the above problems and to provide a construction such that in a power supply apparatus having power supply circuits of a plurality of systems in which a reference voltage generating circuit, a reference oscillating circuit, an overcurrent (voltage) protecting circuit, and other circuits which are used for a power supply control are commonly constructed, an individual control of each power supply system such as a power management (power saving control) or the like can be effectively performed.

To solve the above problems, according to the invention, there is provided a power supply apparatus having a plurality of power supply circuits of at least two or more systems, comprising: a first power supply circuit which is not disconnected; a controller which is driven by the first power supply circuit; a second power supply circuit which is disconnected by the controller in accordance with predetermined conditions; a power supply controller circuit, provided commonly for the first and second power supply circuits, for commonly controlling the first and second power supply circuits in accordance with a feedback signal corresponding to output states of the power supply circuits which are obtained through a feedback circuit provided for an output circuit of at least the second power supply circuit; and a feedback parameter converter for generating a feedback signal that is almost equivalent to that in the case where the second power supply circuit is executing a normal operation and feeding back to the power supply controller circuit so that the controller compensates an output fluctuation of the feedback circuit provided for the output circuit of the second power supply circuit to be disconnected in accordance with a control signal to disconnect the second power supply circuit.

DETAILED DESCRIPTION OF THE PREFERRED EMBODIMENT

Figure 1:
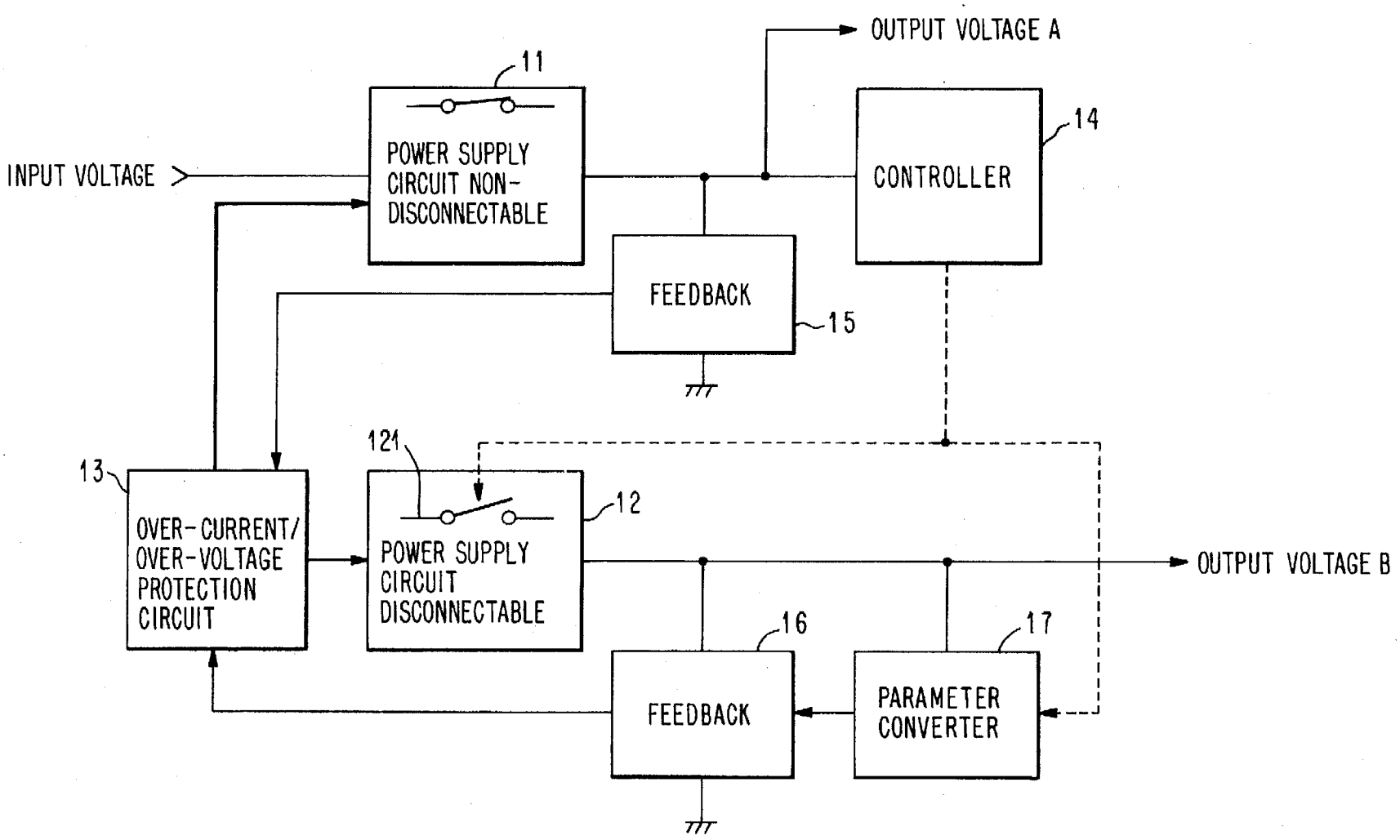
FIG. 1 is a block diagram of a power supply apparatus using the invention.

The invention will now be described in detail hereinbelow with respect to an embodiment shown in the drawings. FIG. 1 shows a structure of a power supply apparatus of an electronic apparatus using the invention.

In FIG. 1, reference numeral 11 denotes a power supply circuit (A) to drive a controller 14 and 12 indicates a power supply circuit (B) which needs a power management (power saving) control, namely, which is disconnected in accordance with specific conditions. The P/S circuit 11 supplies an output voltage A. The P/S circuit 12 supplies an output voltage B. For example, the output voltage A is set to 5V and is supplied to not only the controller 14 but also a logic circuit system (not shown) of an electronic apparatus. The output voltage B is set to 9V and is supplied to a mechanical circuit system (not shown: a motor or the like).

Reference numeral 13 denotes a power supply controller circuit which is commonly constructed for two systems to control both of the power supply circuits 11 and 12. The P/S controller circuit 13 is constructed by an overcurrent (overvoltage) protecting circuit or the like.

The controller 14 is constructed by a CPU, a memory, and other elements and receives the supply of the output voltage A of the power supply circuit 11 and executes a power supply control, which will be explained hereinlater. Further, the controller 14 can also operate as a controller to control the whole apparatus.

Reference numeral 15 denotes a feedback circuit to feed back an output voltage (or current) to stabilize the output of the power supply circuit (A) 11. Reference numeral 16 denotes a feedback circuit to stabilize the output of the power supply circuit (B) 12 and the feedback circuit 16 is similar to the circuit 15. Reference numeral 17 denotes a feedback parameter converter which is used for the power supply circuit 12 to be disconnected in accordance with conditions. The feedback parameter converter 17 is controlled by the controller 14.

Further, a circuit disconnecting apparatus 121 to disconnect the circuit to be disconnected in the circuit is provided in the power supply circuit 12 for the purpose of the power saving control. The circuit disconnecting apparatus 121 is controlled by the controller.

In the embodiment, the power supply controller circuit 13 detects the feedback signal (current or voltage detection signal or the like) indicative of each output state of the power supply circuits 11 and 12 which are generated from the feedback circuits 15 and 16, thereby stabilizing the outputs of the power supply circuits 11 and 12 in accordance with the feedback signals, respectively. Such a control is executed by, for example, PWM controlling a driving clock in the case where the power supply circuits 11 and 12 are constructed by switching power supplies or the like.

The power supply controller circuit 13 has a protecting circuit for detecting an overcurrent (overvoltage) state of each of the power supply circuits 11 and 12 through the feedback circuits 15 and 16 and for stopping the outputs of the power supply circuits if such a state occurs.

Generally, an overcurrent state can be detected by measuring a decrease in output voltage and an overvoltage state can be detected by measuring an increase in output voltage through the feedback circuits 15 and 16, respectively. For easiness of explanation, it is now assumed hereinbelow that the power supply controller circuit 13 executes a protecting operation such that the feedback circuits 15 and 16 detect the overcurrent state and the outputs of the power supply circuits 11 and 12 are stopped.

The protecting circuit in the power supply controller circuit 13 is commonly constructed by a decrease in costs or other reasons. When one of the output voltages drops, the protection is made effective for both of the output voltages.

In the above construction, when there is no need to make the power supply circuit 12 operative, in order to reduce the electric power consumption of the power supply circuit 12, the controller 14 disconnects the circuit disconnecting apparatus 121 in accordance with a proper detecting condition.

In the conventional construction, when such a control is executed, an overcurrent protection of the power supply controller circuit 13 operates due to the drop of the detection voltage of the feedback circuit 16. The power supply of the power supply circuit 11 is also stopped.

To avoid such a problem, in the embodiment, the controller 14 drives the feedback parameter converter 17 and falsely generates a feedback signal such as not to make the overcurrent protecting circuit in the power supply controller circuit 13 operative (or feedback signal of a situation such that the power supply circuit 12 is not disconnected) for the power supply controller circuit 13, thereby preventing that the power supply of the power supply circuit 11 stops.

Figure 4:
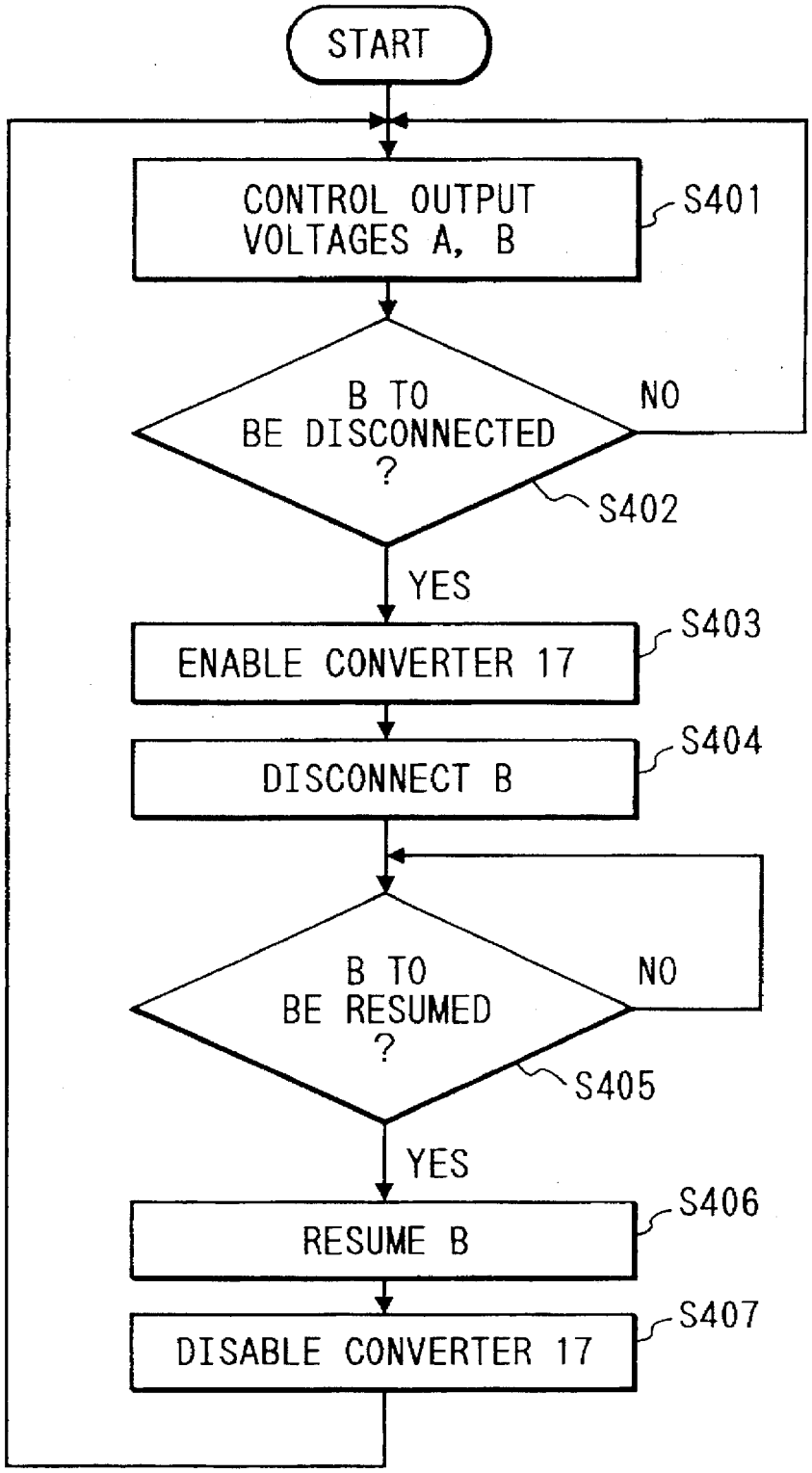
FIG. 4 is a flowchart showing a processing operation of the embodiment.

The above operation will now be briefly explained in accordance with a flowchart of FIG. 4. In step S401, the power supply controller circuit 13 controls the power supply circuits 11 and 12. When an overcurrent or the like occurs, the protecting circuit is made operative.

In step S402, the controller 14 judges whether the output voltage B is disconnected or not. As a condition to stop the output voltage B, there is a condition such that the mechanical circuit system such as a hard disk drive or the like is not used or the like.

In step S403, in case of disconnecting the output voltage B, the controller 14 drives the feedback parameter converter 17.

In step S404, the controller 14 controls the power supply circuit 12 so as to disconnect the output voltage B.

In step S405, when the output voltage B is again generated, for example, when a hard disk drive is used or the like, the controller 14 controls the power supply circuit 12, thereby allowing the output voltage B to be again Generated in step S406.

In step S407, the controller 14 stops the driving of the feedback parameter converter 17.

Figure 2:
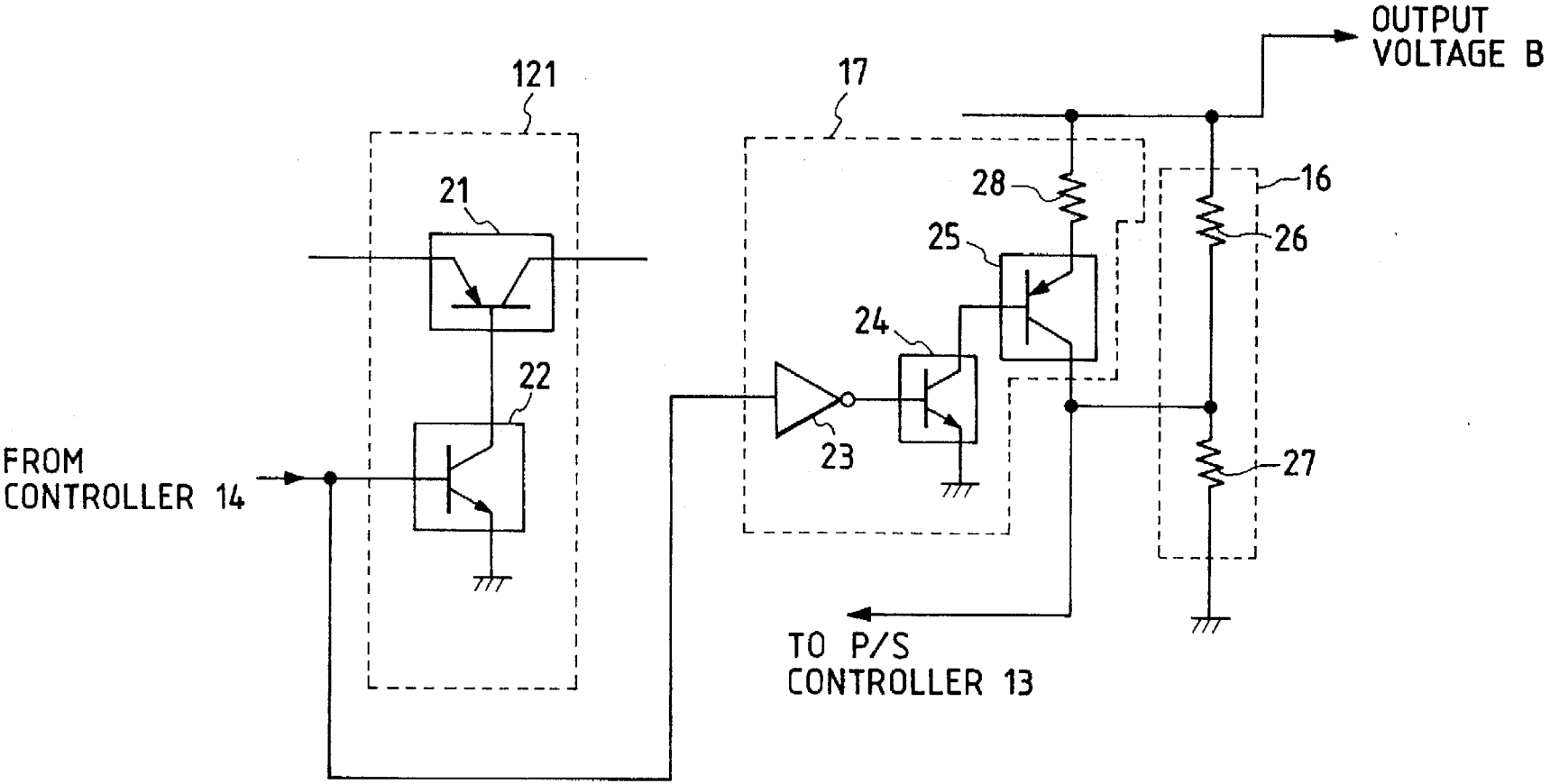
FIG. 2 is a circuit diagram showing in detail a main section of the power supply apparatus of FIG. 1.
Figure 3:
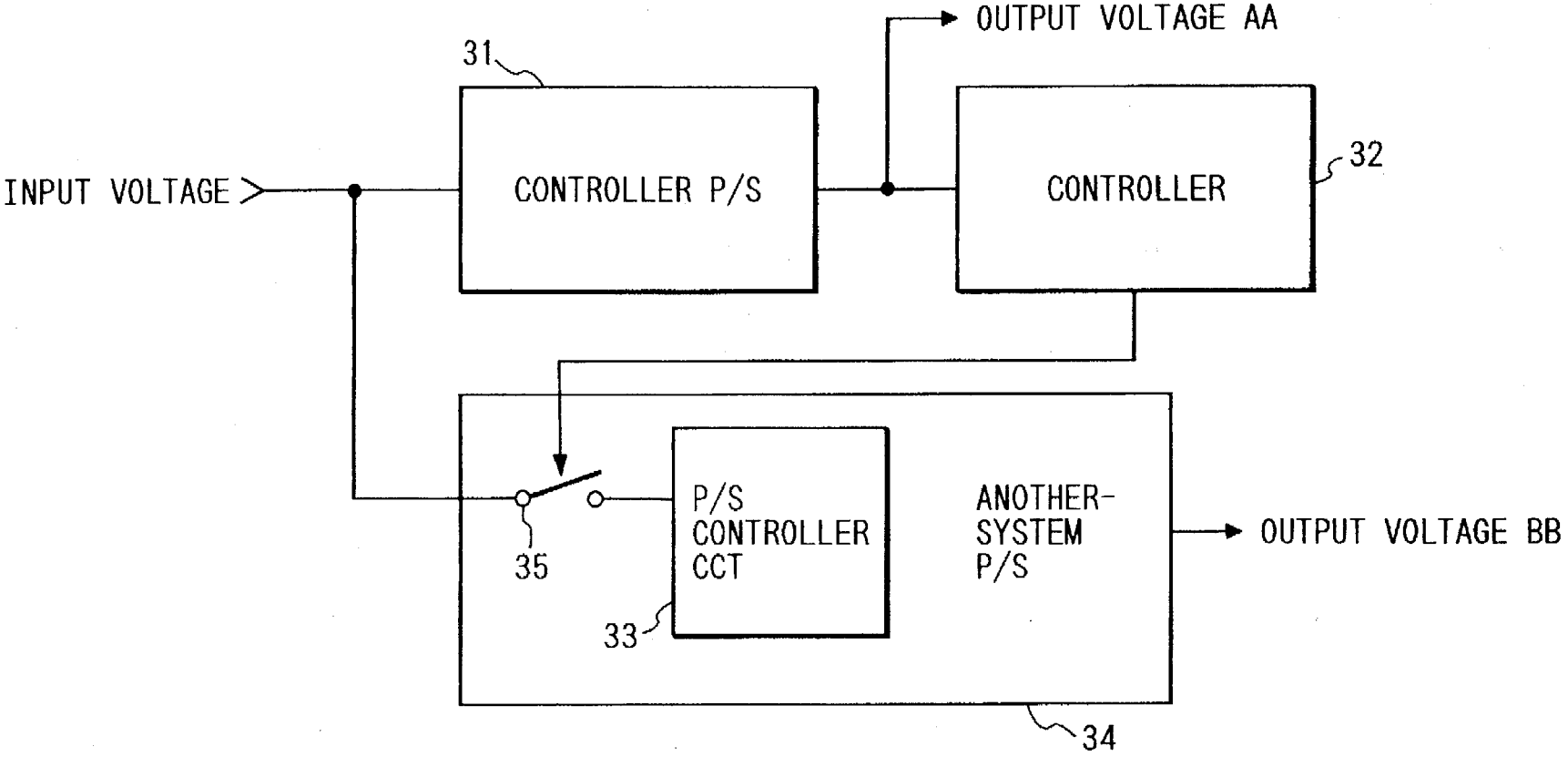
FIG. 3 PRIOR ART
FIG. 3 is a block diagram of a conventional power supply apparatus.

Such a control can be realized by constructing the feedback circuit 16, feedback parameter converter 17, and circuit disconnecting apparatus 121 as shown in FIG. 2.

Namely, as shown in FIG. 2, now assuming that a logic L (low level) is transmitted in case of disconnecting the power supply circuit B, an emitter and a collector of a digital transistor 21 is inserted as a switch into a circuit to be disconnected in the power supply circuit 12.

To assist the driving of the digital transistor 21, a digital transistor 22 is arranged and a base of the digital transistor 21 is controlled. Now, assuming that the base of the digital transistor 21 is set to a logic H (high level), the power supply of the power supply circuit 12 is continued. When the logic L is inputted to the base of the digital transistor 21, the power supply of the power supply circuit 12 is stopped. The digital transistors 21 and 22 construct the circuit disconnecting apparatus 121 of FIG. 1.

In the embodiment, it is assumed that there is performed a control such that even if the circuit disconnecting apparatus 121 is shut off, the output voltage B of the power supply circuit 12 is not perfectly set to 0 but the output voltage B of the power supply circuit 12 is dropped to a predetermined voltage at which the power saving can be effectively executed.

The feedback circuit 16 is constructed by resistors 26 and 27. The resistors 26 and 27 divide the output voltage B and feed back the divided voltage to the power supply controller circuit 13.

The feedback parameter converter 17 simulates the operation of the feedback circuit 16 when the power supply circuit 12 is shut off. The converter 17 has a digital transistor 25 for inserting or non-inserting a resistor 28 between an output line of the power supply circuit 12 and a middle point of the resistors 26 and 27. A base of the digital transistor 25 is controlled through an inverter 23 and a digital transistor 24.

In the above construction, when the normal power supply is performed, both of the power supply circuits 11 and 12 operate and the feedback circuits 15 and 16 feed back the output voltages A and B of the power supply circuits 11 and 12 to the power supply controller circuit 13, thereby executing the output stabilization and overcurrent control of both systems.

On the other hand, in case of disconnecting the power supply circuit 12 by the controller 14 in accordance with predetermined conditions, the logic L is inputted to the digital transistor 22 and inverter 23. Thus, the digital transistor 21 is shut off and the output voltage B drops to a predetermined low voltage.

At the same time, the logic L from the controller 14 is converted to the logic H by the inverter 23, so that the digital transistor 25 is made conductive. The resistor 26 of the feedback circuit 16 and the resistor 28 of the feedback parameter converter 17 are connected in parallel.

In this instance, resistance values of the resistors 26 and 28 are set to (resistor 26)>(resistor 28) and are set in a manner such that the divided voltages by the resistance values of the resistors 26 and 27 at the time of the normal power supply and the time of the shut-off of the power supply circuit 12 are not so different.

Thus, since the power supply controller circuit 13 inputs the feedback signal similar to that in the case where the power supply circuit 12 is executing the ordinary power supplying operation, a situation such that the power supply of the power supply circuit 11 is also stopped by the overcurrent protection of the power supply controller circuit 13 doesn't occur. The power saving of the system of the power supply circuit 12 can be performed.

According to the embodiment as mentioned above, by merely adding the simple feedback parameter converter 17 as shown in FIG. 2, even in the simple circuit construction in which the power supply controller circuit 13 is commonly used in the power supply circuits 11 and 12, the power saving control for disconnecting (or decreasing the output) only one system of the power supply circuits 11 and 12 as necessary can be executed. In this case, the system whose power saving is not performed is not influenced.

The above embodiment has been described on the assumption that the output voltage B is not perfectly set to 0 even in the power saving mode of the power supply circuit 12 as a prerequisite. However, so long as there is used a construction such that in the case where the power supply circuit 12 is disconnected, it is necessary to set the output voltage B to 0 at the time of the power saving mode and the feedback voltage of the feedback circuit 16 drops to 0, by using the high level voltage obtained by inverting the logic L of the controller 14 to disconnect the circuit disconnecting apparatus 121 by the inverter 23 and supplying the high level voltage to the middle point of the resistors 26 and 27, a proper feedback voltage is returned from the feedback parameter converter 17 to the power supply controller circuit 13. An operation similar to that in the above construction can be realized.

The example in which the overcurrent protection is performed as a control of the power supply controller circuit 13 which is commonly constructed for the power supply circuits 11 and 12 has been shown and described above.

However, the invention can be also obviously embodied in a power supply apparatus such that power supply outputs (voltages, currents) of a plurality of systems are fed back to a common power supply controller circuit and some common control (overcurrent control, overvoltage control, power control, etc.) is executed in accordance with such a feedback.

As will be obviously understood from the above description, according to the invention, it is possible to provide the simple, cheap, and excellent power supply apparatus which can stably operate and in which the feedback signal similar to that in the case where the second power supply circuit is executing the normal operation is generated so as to compensate the output fluctuation of the feedback circuit provided for the output circuit of the second power supply circuit which is disconnected by the feedback parameter converter, such a feedback signal can be fed back to the power supply controller circuit, a state in which the second power supply circuit is not apparently disconnected is virtually created, thereby making it possible to prevent that the operations of the power supply system other than the second power supply circuit are influenced (particularly, so as not to disconnect the systems other than the second power supply circuit), an advantage such that the power supply controller circuit is commonly constructed can be maintained, and the individual control of each power supply system such as a power management (power saving control) or the like can be effectively performed.

What is claimed is:

1. A power supply control apparatus for controlling a power supply circuit for outputting voltages of at least two systems, comprising:

a first power supply circuit for generating a first voltage;

a second power supply circuit for generating a second voltage;

a controller circuit which is driven by said first voltage;

a disconnecting circuit for disconnecting said second voltage by said controller circuit in accordance with a predetermined condition;

a power supply controller circuit for controlling said second power supply circuit on the basis of said second voltage; and a supplying circuit for supplying a signal indicative of a state in which said second voltage has been outputted to said power supply controller circuit when said second voltage is disconnected by said disconnecting circuit.

2. An apparatus according to claim 1, wherein said supplying circuit is constructed by a resistor circuit.

3. An apparatus according to claim 1, wherein said second voltage is shut off after said signal was supplied to said power supply controller circuit by said supplying circuit.

4. A power supply apparatus having at least two power supply systems, said apparatus comprising:

a first power supply circuit for generating a first voltage;

a second power supply circuit for generating a second voltage;

control means for controlling said first and second power supply circuits based on the first and second voltages generated by said first and second power supply circuits, respectively;

making means for making said second power supply circuit inoperative; and signal supply means for supplying a signal to said control means when said making means is to make said second power supply circuit inoperative, the signal being indicative of a state as if said second power supply circuit were operative.

5. An apparatus according to claim 4, wherein said signal supply means comprises a resistor circuit.

6. An apparatus according to claim 4, wherein said making means makes said second power supply circuit inoperative after said signal supply means has supplied the signal to said control means.

7. A power supply control method of controlling a power supply circuit for outputting voltages of at least two systems, comprising the steps of:

generating a first voltage by a first power supply circuit;

generating a second voltage by a second power supply circuit;

driving a controller circuit responsive to the first voltage;

disconnecting the second voltage by the controller circuit according to a predetermined condition;

controlling the second power supply circuit on the basis of the second voltage by a power supply control circuit; and supplying a signal indicative of a state in which the second voltage has been outputted to the power supply control circuit when the second voltage is disconnected.

8. The method of claim 7, wherein the state indicative signal is supplied by a resistor circuit.

9. The method of claim 7, further comprising the step of shutting off the second voltage after the state indicative signal is supplied to the power supply controller circuit.

10. A power supply control method of controlling a power supply apparatus having at least two power supply systems, comprising the steps of:

generating a first voltage by a first power supply circuit;

generating a second voltage by a second power supply circuit;

controlling the first and second power supply circuits based on the first and second voltages;

making the second power supply inoperative;

supplying a signal indicative of a state as if the second power supply circuit were operative to control the first and second power supply circuits when the second power supply is made inoperative.

11. A power supply control method according to claim 10, wherein the state indicative signal is supplied by a resistor circuit.

12. A power supply control method according to claim 10, wherein the second power supply circuit is made inoperative after the state indicative signal has been supplied.

* * * * *

UNITED STATES PATENT AND TRADEMARK OFFICE

CERTIFICATE OF CORRECTION

PATENT NO. : 5,691,630

DATED : November 25, 1997

INVENTOR(S): TAKASHI CHOSA

It is certified that error appears in the above-identified patent and that said Letters Patent is hereby corrected as shown below:

COLUMN 1

Line 9, "those" should read --that--;
Line 26, "the" should read --a--.

COLUMN 2

Line 52, "in case" should read --in the case--.

COLUMN 3

Line 8, insert --are turned off-- after "systems";
Line 20, "saving control)" should read --saving) control--.

COLUMN 4

Line 60, "by a decrease in" should read --to lessen its--.

COLUMN 5

Line 10, delete "of a situation";
Line 12, delete "that";
Line 13, delete "the" (second occurrence);
Line 13, "stops" should read --from stopping--;
Line 23, delete "or the like".
Line 33, "Generated" should read --generated--.

UNITED STATES PATENT AND TRADEMARK OFFICE

CERTIFICATE OF CORRECTION

PATENT NO. : 5,691,630

DATED : November 25, 1997

INVENTOR(S): TAKASHI CHOSA

It is certified that error appears in the above-identified patent and that said Letters Patent is hereby corrected as shown below:

COLUMN 6

Line 2, "non-inserting" should read --removing--;
Line 26, "divided voltages" should read --voltages divided--;
Line 44, "output" should read --output of--.

COLUMN 7

Line 27, "saving control)" should read --saving) control--.

Signed and Sealed this

Twenty-sixth Day of May, 1998

*Attest:*

Bruce Lehman

BRUCE LEHMAN

*Attesting Officer*

*Commissioner of Patents and Trademarks*